US008490293B2

(12) United States Patent
Vilhunen

(10) Patent No.: US 8,490,293 B2
(45) Date of Patent: Jul. 23, 2013

(54) FLAT SURFACE DRYER

(75) Inventor: Juhani Vilhunen, Espoo (FI)

(73) Assignee: Korpikorpi Oy, Helsinki (FI)

( * ) Notice: Subject to any disclaimer, the term of this patent is extended or adjusted under 35 U.S.C. 154(b) by 1422 days.

(21) Appl. No.: 11/346,234

(22) Filed: Feb. 3, 2006

(65) Prior Publication Data

US 2006/0196074 A1 Sep. 7, 2006

(30) Foreign Application Priority Data

Feb. 3, 2005 (FI) ..... 20050121

(51) Int. Cl.
*F26B 3/00* (2006.01)

(52) U.S. Cl.
USPC ..... 34/443; 34/117; 34/621; 34/624

(58) Field of Classification Search
USPC ..... 34/443, 117, 621, 624
See application file for complete search history.

(56) References Cited

U.S. PATENT DOCUMENTS

| | | | | |
|---|---|---|---|---|
| 4,561,800 | A | 12/1985 | Hatakenaka et al. | |
| 4,571,849 | A | 2/1986 | Gardner et al. | |
| 6,845,570 | B2 * | 1/2005 | Paterson | 34/226 |

FOREIGN PATENT DOCUMENTS

| | | |
|---|---|---|
| EP | 0 777 787 | 6/1997 |
| EP | 0 979 378 | 2/2000 |
| FI | 105500 | 1/2000 |
| GB | 1 536 067 | 12/1978 |

* cited by examiner

*Primary Examiner* — Steve M Gravini
(74) *Attorney, Agent, or Firm* — Young & Thompson

(57) ABSTRACT

A flat surface dryer (1) includes a sealed targeting box (2) with its replacement and exhaust air ports (12, 31; 20), and an air fan (3), the flat surface dryer (1) being an air circulating flat surface dryer, including an element (19, 21, 28, 30) for regulating the amounts of replacement air and exhaust air with respect to the total amount of air circulated by the air fan (3). Also described is a method for drying a flat surface (6) with the flat surface dryer (1).

16 Claims, 3 Drawing Sheets

FLAT SURFACE DRYER

FIELD OF THE INVENTION

This invention relates to a flat surface dryer, consisting of a targeting box, a duct system present therein along with air guides therefor, as well as a fan. The invention further relates to a respective method for drying a flat surface.

BACKGROUND OF THE INVENTION

The drying of concrete and brick structured floors has been traditionally effected by using e.g. condensing or absorption dryers. However, such prior art dryers are relatively slow. Faster drying has been attempted by introducing microwave or infrared dryers. One solution, which involves the use of an infrared dryer, has been described in EP 0 979 378 B1. Prior known are also flat surface dryers, which are provided with a separate hot-air fan for blowing into a targeting box and with a separate exhaust fan for discharging the air blown into the targeting box. Such foregoing solutions, one of which will described more precisely hereinbelow, represent the closest prior art.

A flat surface dryer according to the prior art has been described in Fl 105500 B. The apparatus disclosed in this cited publication consists of an air guidance box with its sealing, said air guidance box being placed against a surface to be dried. The air guidance box is fitted with a fan for blowing heated air into the interior of the air guidance box. An objective is to guide the heated air for spreading it as effectively as possible over the entire section of a surface to be dried which is covered by the air guidance box. This is effected by using air guides integrally secured to the air guidance box. Drying air is discharged by way of a discharge hose. The discharge hose may also be fitted with a separate fan for an enhanced discharge of air from the targeting box.

The prior art equipment involves several drawbacks, impeding use of the equipment. For example, the use of microwave dryers in an apartment building entails that apartments below the one being dried be also evacuated of inhabitants for the duration of a drying process. This causes undue inconvenience for other inhabitants of the apartment building. In addition, microwaves may be harmful for existing heating, plumbing, ventilation and electrical installations.

Infrared drying is an option somewhat speedier than traditional condensing or absorbing dryers, but still the drying of a drenched concrete slab cannot be managed within a week. In addition, due to a partially uncovered design of the apparatus, some of the thermal energy burdens unnecessarily the environment.

Drawbacks in the solution disclosed in Fl 105500 B include an energy demand of the apparatus which is high in view of the attainable drying result. In other words, the apparatus has a very poor efficiency. The apparatus has an energy consumption of about 1500-2000 W/m$^2$ to be dried. The apparatus has a high demand for replacement air and thus the space to be dried must be provided with unobstructed supply of air. In practice, this means (especially in apartment buildings) that the door or window to a space to be dried must be left open. The doors open to other parts of the apartment increase the level of inconvenient noise in the apartment, degrading living conditions. At the same time, the thermal load emerging from the drying apparatus proceeds at least partially to other parts of the apartment.

The high demand of energy per unit area to be dried also limits the number of drying devices as the supply of energy is often a limiting factor regarding the number of apparatus units. This also hinders the drying of extensive areas to be dried or requires separate arrangements for supplying electric power to the dryers.

The use of several dryers in one and the same space requires an especially large amount of replacement air and produces an equal amount of moist and hot exhaust air. The management of such quantities of air is likely to confuse the building's ventilation unless separate ducting is provided all the way out, for example across a window or a balcony. Such assembly of duct systems has to be done quite often through inhabited rooms, affecting seriously the living conditions or possibly even inhibiting the use of an apartment during the drying process. In addition, the continuously open doors allow the rest of the apartment to be pervaded by a thermal load and noise (running sound of the dryer motor) delivered by the apparatus.

In some cases, the supply of adequate replacement air and the discharge of abundant exhaust air is not possible by way of open windows or doors. Reasons for this include e.g. unauthorized passers-by, cold weather in winter, snowfall, rain or another reason like that.

The prior art apparatus units involve problems also in terms of providing a consistent distribution of thermal energy over the entire area to be dried. Minor leaks between a floor surface and a targeting box confuse effectively the movements of air within a targeting box. Moreover, adjustment (ratio between blowing and suction rates) of the apparatus is difficult.

Warming of the electrical components in drying equipment, due to the pervasion of abundant hot exhaust air into the surroundings and due to a high conduction of heat through a dryer's structures to electrical equipment, causes significant problems in terms of operating reliability of the electrical equipment.

SUMMARY OF THE INVENTION

An apparatus and method of the invention provide considerable benefits over prior art equipment and methods. Such benefits include, among others:

- lower energy consumption and thereby an improved efficiency (energy consumption about 500 W/m$^2$ to be dried,
- lesser amount of replacement air per square meter,
- less noise trouble, i.e. a quieter running sound
- more even distribution of heat over the surface to be dried,
- no need for exhaust air hoses extending all the way out,
- very low thermal stress except within the area to be dried, i.e. no emissions of warm air to the surroundings,
- less heat exposure for electrical components,
- faster drying,
- no need for open windows or doors for replacement air or exhaust air,
- enables comfortable living elsewhere in the residence during the course of drying,
- no interferences with ventilation elsewhere in the building, even in large-scale installations of more than 20 drying units, despite the fact that exhaust air is conveyed directly into the building's normal ventilation.

An object of an apparatus and method according to the invention is also to eliminate or at least to partially alleviate the above drawbacks resulting from the use of prior art equipment.

These benefits are accomplished by an apparatus and method according to the invention. The invention is based on the idea of circulating the same air several times within a targeting box with intermittent heating thereof, whereby the amounts of replacement air and exhaust air can be maintained at quite a low level.

BRIEF DESCRIPTION OF THE DRAWINGS

The invention will now be described by way of examples with reference to the accompanying drawings, in which.

DETAILED DESCRIPTION OF THE PREFERRED EMBODIMENTS

Figure 1:
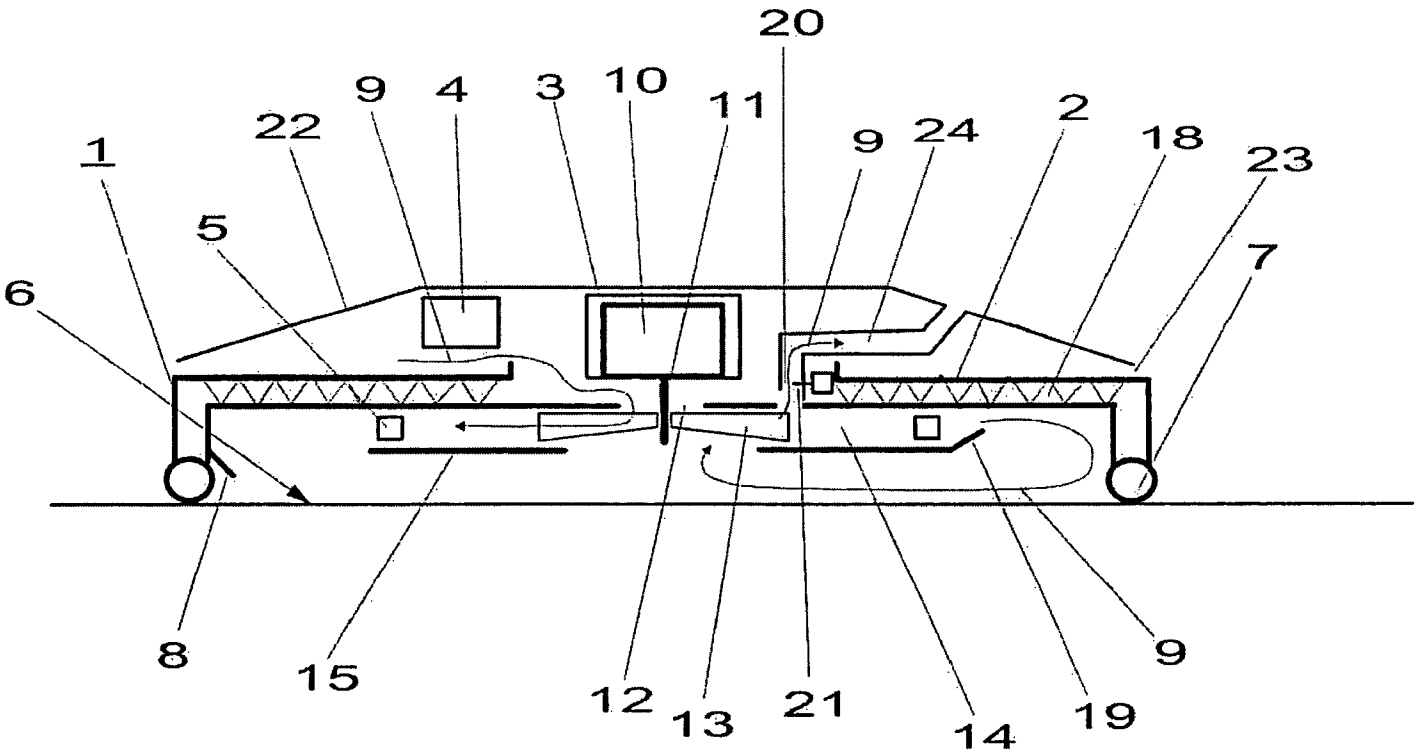
FIG. 1 shows an air circulating flat surface dryer in a simplified cross-sectional elevation.

FIG. 1 shows an air circulating flat surface dryer 1 in a cross-sectional elevation. The air circulating flat surface dryer consists of three main components, which are a targeting box 2, an air fan 3, as well as a distributing box 4 having preferably assembled therein all necessary electric/regulating devices, e.g. for regulating a heating element/elements 5. The targeting box 2 comes into contact with a surface 6 to be dried, such that there is a sealing 7 between the targeting box and the surface to be dried. The employed sealing 7 may preferably be any commercially available slightly heat-resistant sealing. The targeting box has its skirt, alongside the sealing 7, fitted with an air guide 8, capable of deflecting the air flow back towards the air fan 3 which in this example is disposed in the middle of the targeting box. The passage of air within, into and out of the targeting box 2 is indicated by arrows 9. If necessary, the location of the air fan 3 may be elsewhere in the targeting box 2 but, in order to adjust the air flows consistently across the entire targeting box 2, the most convenient position for the air fan 3 is roughly in the middle of for example a rectangular targeting box. Preferably, the air fan 3 positioned in the middle of the targeting box 2 consists of a fan motor 10, which is mounted outside the actual targeting box 2 and rests upon supporting blocks and is elevated thereby slightly above the external surface of the targeting box, of an air fan shaft 11, which extends into the interior of the targeting box through a shaft hole 12 present in the targeting box, as well as of air fan blades 13, which are mounted on the air fan shaft and located within the targeting box.

The air fan blades 13 are sucking air from the middle section of the targeting box 2 and blowing it in the direction of blade tips along a guide channel 14. The guide channel 14 is established between a bottom surface of the targeting box 2 and a spaced base panel 15, which base panel can take any desired form. Preferred forms include for example a circle or a rectangle, but other forms are freely optional as well. The air to be blown into the guide channel 14 discharges from the guide channel for example over each shorter side of a rectangular base panel 15 or consistently over the entire edge of a circular base panel. In the case of a rectangle, the base panel 15 can be completely enclosed over the longer sides, the flow only occurring through openings formed by the shorter sides of the rectangle. Thus, there is no need for separate mounting/riser blocks between the base panel 15 and the targeting box 2. The use of a circular-shape guide channel 14 enables spreading the flow consistently in every radial direction of the circle and attachment to the bottom surface of the targeting box 2 is effected for example by means of peg-like attachment/riser blocks.

The guide channel 14 is provided with a heating element 5 for warming up the air circulated in the targeting box 2. Downstream of the heating element 5 the guide channel 14 is provided also with a temperature sensor/thermostat (not shown in the figure), monitoring the temperature of circulation air and enabling a precise adjustment of the real temperature of circulation air by varying the heating element setups. Associated with the heating element 5 is also an overheating protector (not shown in the figure) for ensuring a safe operation of the apparatus even in possible malfunctions. Preferably, the electromechanical components and flow controlling vanes/guides are mounted on the base panel 15 or a separate mother board (not shown in the figure), which hence also constitutes a section of the flow channel in its position between the base panel and the bottom surface of the targeting box 2. Options like this enable using the same modules in targeting boxes 2 of various shapes and sizes.

The air fan shaft 11 is substantially smaller in diameter than the diameter of the hole 12 prepared therefor in the targeting box. This difference in diameters allows for a controlled flow of replacement air into the targeting box 2 through the shaft hole 12. When the shaft hole 12 is positioned above the air fan blades 13, the air fan 3 functions to suck also replacement air into the interior of the targeting box 2. It is also possible to mount separate extra vanes on the air fan shaft 11 for sucking replacement air into the interior of the targeting box 2 and its guide channel 14. This type of solution will be described later in reference to FIG. 3.

The replacement air into the interior of the targeting box 2 is supplied through a space between the air fan motor 10 and a top surface of the targeting box, the lower temperature of supply air also providing a cooling effect on the motor 10. The same effect is also utilized in cooling a distributing box 4. The distributing box 4 is mounted on top of riser blocks on an external surface of the targeting box 2, the lower-temperature supply air being forced to proceed through a space between the distributing box and the top surface of the targeting box. The distributing box 4 may also have its two opposing sides provided by upturned sections of the targeting box's 2 surface plate, the upturned sections extending preferably all the way to a cover structure 22. This enables separating the distributing box 4 from the hot targeting box 2 and, additionally, allowing cool air to sweep and cool the hottest part of the distributing box. By virtue of this cooling effect, the electric/control devices inside the distributing box 4 function more reliably and have a longer service life. It is further possible to manufacture the targeting box 2 as a sandwich structure by having a thermal insulation 18 between the outer sheets of its shell, which assists in retaining the heat inside the targeting box and at the same time reduces, together with riser blocks present between the distributing box and the targeting box, a thermal stress applied to the distributing box 4. Such a sandwich structure enables a sufficient structural bracing of the targeting box 2, whereby it is also possible, if necessary, to apply external load on top of it. The structure will nevertheless remain very light, which facilitates handling and installation of the equipment. The shell structure can also be reinforced by upturned sections of cover plates, said upturned sections preferably establishing at the same time the sides for the distributing box and a fan motor housing.

The guide channel 14 has its end furthest away from the air fan 3 preferably fitted with an air guide 19, which forces the flow to circle in a controlled fashion along the bottom surface of the targeting box 2 from the middle towards the skirts. A second air guide 8 in the proximity of the sealing 7 of the targeting box 2, which circles preferably along the skirt of the targeting box at least part of the way, assists respectively in deflecting the air flow to run co-directionally with the surface 6 to be dried and back towards the middle of the targeting box, wherefrom the air fan 3 sucks the flow up again and returns the flow into the guide channel 14.

Since the same air is circulated this way several times within the targeting box, the result is a saving of energy which is needed for the heating of drying air. Air is discharged from the targeting box 2 in a controlled manner by way of an exhaust port or passage 20. It is preferred that the exhaust port or exhaust passage opening 20 be adjusted for example by means of a mechanical/electrically operated throttle 21, whereby the rate of a discharging amount of air can be regulated as desired. While air discharges from the exhaust port or passage 20, the corresponding amount of replacement air is coming in through the opening 12 arranged in association with the air fan shaft 11, as described above. This arrangement enables retaining within the targeting box 2 an air pressure which is the same or roughly the same as that existing outside the targeting box. This eliminates heat losses occurring in prior art equipment to the surroundings through a sealing assembly when the targeting box is at a positive pressure, and cold flows into the interior of the targeting box through openings in the sealing assembly when the targeting box is at a negative pressure, said losses or flows confusing the planned flow within the targeting box and leading to a poor drying result.

The ratio of incoming replacement air to the amount of air circulated by the air fan 3 can be determined as desired according to what is required by an object to be dried. This ratio is adjustable in a stepless manner within the range of 1/50-1/500. Preferably, the ratio between the amounts of air lies within the range of 1/100-1/500, and most preferably within 1/200-1/500. Such an amount of air to be discharged in relation to the amount of air to be circulated is sufficient for removing moisture effectively from the structures and the energy consumption of the drying apparatus can be minimized.

On top of the targeting box 2 is preferably still mounted a cover structure 22, which conceals the fan motor 10 and the distributing box 4. The cover structure 22 has an objective of reducing noise delivered by the fan motor 10 to the surroundings. On the other hand, even without a cover structure, the noise effect is quieter than in prior art equipment, because the air fan 3 need not be operated at rotational speeds as high as in the prior art solutions using a direct flow-through. Noise is also reduced by the fact that the fan blades 13 are positioned in a closed space between a double cover formed by the targeting box 2 and the cover structure 22 and the surface 6 to be dried. Thus, the flat surface dryer 1 has the external appearance of a smooth-surfaced and neat design, in which all details are concealed beneath the cover structure 22 and at the same time protected from accidents/bumps/splatters caused for example by a concurrent renovation. Between the cover structure 22 and the targeting box 2 is nevertheless left a sufficient gap 23, by way of which the replacement air finds access into the targeting box while cooling the distributing box 4 and the fan motor 10. The exhaust air can be conveyed along a discharge duct 24 directly through the cover structure 22 outside or by having a discharge conduit deliver the flow towards the gap 23 between the cover structure and the targeting box, whereby the flow has a clear discharge route that way.

The embodiment implemented on the drying principle based on circulating air is feasible not only by means of a targeting box for flat surface drying but also by fitting an air circulation duct system in a targeting box applicable for corner structures. In this case, it is appreciated that the shape of a guide channel 14 will be different, yet the apparatus remains identical regarding its operating principle.

Figure 2:
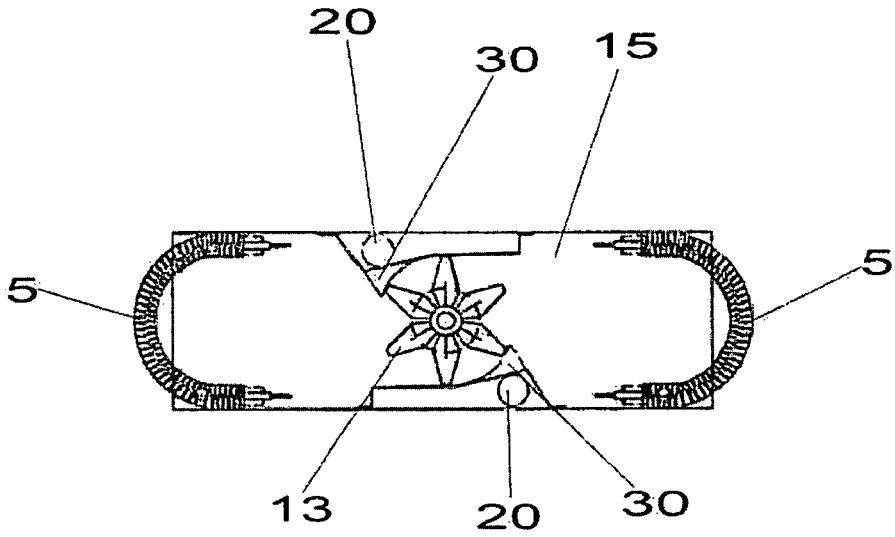
FIG. 2 shows in more detail one preferred embodiment of a base panel.

FIG. 2 depicts one preferred embodiment of a base panel 15, which is mounted on an internal surface of a targeting box 2 for providing a guide channel 14. This embodiment has made use of horseshoe-shaped heating elements 5 for warming up the air, but of course any other heating element works just as well. Next to the ends of air fan blades 13 are mounted air guides 30 for deflecting a necessary amount of exhaust air into an exhaust port 20.

Figure 3:
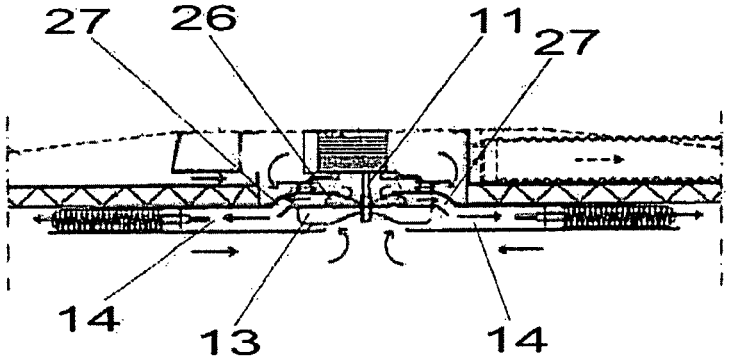
FIG. 3 shows the base panel of FIG. 2 fitted to a flat surface dryer.

FIG. 3 illustrates how the base panel 15 of FIG. 2 is fitted in a targeting box 2 for supplying replacement air and for discharging exhaust air from the targeting box. An air fan shaft 11 is fitted with extra vanes 26 for enhanced suction and for providing an improved output of replacement air. In this case, the replacement air can be guided along its own channel 27 to travel over the actual flow circulating blade 13 and to link it with a circulating air guide channel 14 only downstream of the blade tip. The exhaust ports shown in FIG. 2 and the supply ports 27 of FIG. 3 are preferably at the same distance from the air fan shaft 11, yet have different degrees of angle.

Figure 4:
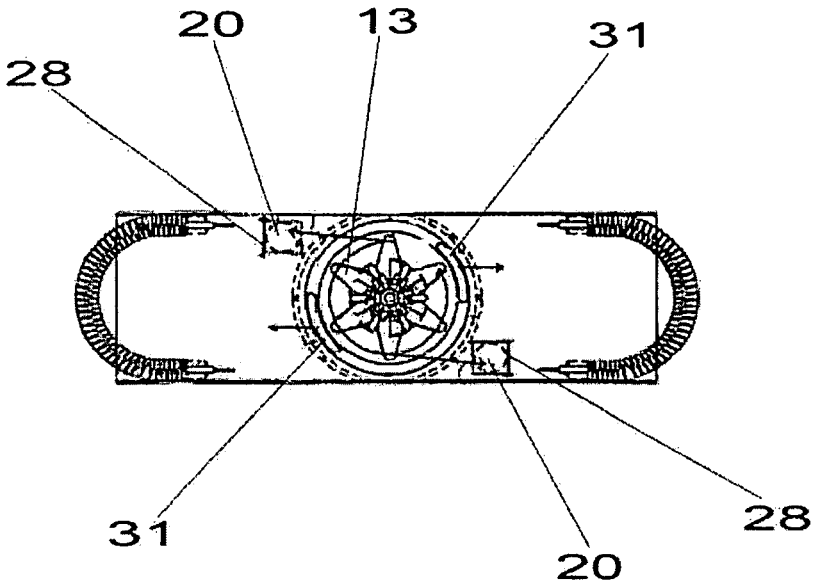
FIG. 4 shows a second preferred embodiment in plan view for replacement air and exhaust air ports as well as for adjustments.

FIG. 4 depicts another preferred embodiment for replacement and exhaust air ports 31 and 20 as well as for the position thereof in relation to fan blades 13 and regulation of air flows. In this embodiment, the replacement ports 31 are positioned outside the blades 13 and the suction of a flow produced by the blades provides a sufficient output of replacement air into a targeting box 2. The exhaust air ports 20 have a rear section thereof (in downstream direction) provided with air guides 28, which assist in improving the direction of exhaust air towards the exhaust duct. It has been verified experimentally that a disposition of the replacement and exhaust air ports 31 and 20, as described in this embodiment, is highly preferred in aerodynamic sense. Hence, the exhaust air port 20 develops a positive pressure, which assists in the discharge of air from the targeting box, and the replacement air port 31 develops a negative pressure, which assists in the supply of air into the targeting box.

Figure 5:
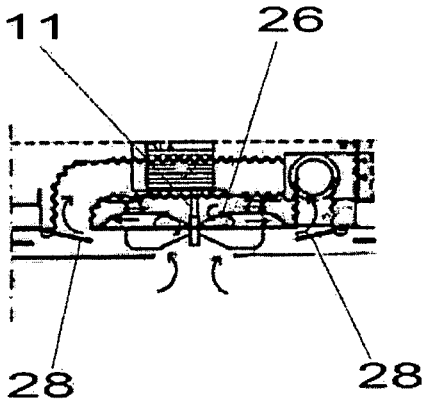
FIG. 5 shows the embodiment of FIG. 4 in a side view.

FIG. 5 shows the embodiment of FIG. 4 in a side view. By manipulating a hinged air guide 28, the ratio between flows can be regulated as desired. In the depicted solution, use is even made of extra vanes 26 on an air fan shaft 11 similar to those shown in FIG. 3 for producing replacement air. The extra vane 26 delivers air in through the port 31 (FIG. 4). A guide like this, or any other flow guide 8, 19, 28 or 30 described above, need not necessarily be adjustable, but it can also be a fixed solution. Some or all of the flow guides 8, 19, 28 or 30 may also be perforated, some of the flow being able to pass directly through the guide and some being deflected in a direction determined by the guide.

The solution according to the invention is capable of providing with a single motor all three (flow in, air circulation, flow out) air flows required in a flat surface dryer. Several prior art devices, in which an amount of air circulates just once within a targeting box, are provided with separate fans for incoming air and outgoing air.

A few embodiments for a solution of the invention have been described above by way of example only. The scope of protection for the invention is by no means limited by these embodiments, but the scope of protection shall be defined in accordance with the appended claims.

The invention claimed is:

1. A flat surface dryer (1), comprising a sealed targeting box (2) with its replacement and exhaust air ports (12, 31; 20), and an air fan (3), the flat surface dryer (1) being an air circulating flat surface dryer, including means (19, 21, 28, 30) for regulating the amounts of replacement air and exhaust air with respect to the total amount of air circulated by the air fan (3), and means for sealing the targeting box against a flat surface to be dried.

2. A flat surface dryer (1) as set forth in claim 1, characterized in that the means (19, 21, 28, 30) for regulating the amounts of replacement air and exhaust air are fixed or manually or electrically adjustable air guides or throttles for a flow port/ports.

3. A flat surface dryer (1) as set forth in claim 2, characterized in that the ratio between exhaust air and circulated air is 1/50-1/500.

4. A flat surface dryer (1) as set forth in claim 3, characterized in that the air fan (3) is set in the middle of the targeting box (2), such that the fan has its motor (10) outside the targeting box (2) and its flow impelling blades (13) inside the targeting box (2).

5. A flat surface dryer (1) as set forth in claim 4, characterized in that an internal surface of the targeting box (2) and a base panel (15) placed therebelow constitute a guide channel (14) for passing the air flow forward from the air fan blades (13) along a bottom surface of the targeting box (2).

6. A flat surface dryer (1) as set forth in claim 5, characterized in that the guide channel (14) has its end, at least along a part of the guide channel's (14) outlet, provided with a flow guide (19) for deflecting the flow to proceed in a more intimate contact along the bottom surface of the targeting box (2).

7. A flat surface dryer (1) as set forth in claim 6, characterized in that a heating element (5) is disposed in the guide channel (14) downstream of the air fan (3) .

8. A flat surface dryer (1) as set forth in claim 7, characterized in that the targeting box (2) has its sealing (7) formed with an air guide (8) at least along a part of a skirt of the targeting box (2), said air guide (8) deflecting the flow back towards the middle of the targeting box (2).

9. A flat surface dryer (1) as set forth in claim 8, characterized in that the output of replacement air is enhanced by extra vanes (26) mounted on the air fan's (3) shaft (11) for an enhanced suction towards the interior of the targeting box (2).

10. A method for drying a flat surface (6), said method comprising the following steps of:

providing a targeting box (2) sealed against the surface (6) to be dried and provided with its air supply and exhaust ports (12, 31; 20), providing air into the interior of the targeting box (2) by way of the supply air port (12, 31), making the air circulate around the targeting box (2), and discharging the air from the targeting box (2) by way of the exhaust air port (20), characterized in that the method further comprises regulating the ratio of exhaust air and the amount of air circulated by a fan (3) by guiding the flow to the exhaust port (20) and/or by using means (19, 21, 28, 30) for adjusting the size of the supply and/or exhaust port (12, 31; 20).

11. A method as set forth in claim 10, characterized in that it comprises providing a guide channel (14) between the targeting box (2) and a base panel (15) installed therebelow and using the flow channel (14) for passing the flow along an internal surface of the targeting box (2) towards a sealed skirt of the targeting box (2).

12. A method as set forth in claim 11, characterized in that it comprises installing a heating element/elements (5) in said guide channel (14) downstream of the fan (3) for heating the drying air.

13. A method as set forth in claim 12, characterized in that the supply air is first aspirated inside the targeting box (2) and only then heated with the heating element (5).

14. A method as set forth in claim 13, characterized in that the flow is deflected back towards the middle of the targeting box (2) by means of a flow guide (8) present at a skirt of the targeting box (2).

15. A method as set forth in claim 14, characterized in that the ratio between exhaust air and circulation air is adjusted for a ratio of 1/50-1/500.

16. A method as set forth in claim 14, characterized in that the ratio between exhaust air and circulation air is adjusted for a ratio of 1/100-1/500.

* * * * *